US006839444B2

(12) United States Patent
Ellis et al.

(10) Patent No.: US 6,839,444 B2
(45) Date of Patent: Jan. 4, 2005

(54) LOUDSPEAKERS

(75) Inventors: Christien Ellis, Hertfordshire (GB); Nicholas Patrick Roland Hill, Cambridge (GB)

(73) Assignee: New Transducers Limited, Cambridgeshire (GB)

( * ) Notice: Subject to any disclaimer, the term of this patent is extended or adjusted under 35 U.S.C. 154(b) by 392 days.

(21) Appl. No.: 09/995,865

(22) Filed: Nov. 29, 2001

(65) Prior Publication Data

US 2002/0094095 A1 Jul. 18, 2002

Related U.S. Application Data

(60) Provisional application No. 60/250,106, filed on Dec. 1, 2000.

(30) Foreign Application Priority Data

Nov. 30, 2000 (GB) ..... 0029098

(51) Int. Cl.[7] ..... H04R 25/00
(52) U.S. Cl. ..... 381/152; 381/407; 381/423
(58) Field of Search ..... 381/152, 396, 381/423, 431, 400, 407

(56) References Cited

U.S. PATENT DOCUMENTS

| | | | | |
|---|---|---|---|---|
| 4,532,383 A | | 7/1985 | Willy | |
| 4,847,908 A | * | 7/1989 | Nieuwendijk et al. | 381/424 |
| 6,694,038 B1 | * | 2/2004 | Azima | 381/423 |

FOREIGN PATENT DOCUMENTS

| | | |
|---|---|---|
| EP | 0 969 691 A1 | 1/2000 |
| WO | WO 97/09842 A1 | 3/1997 |
| WO | WO 97/09846 A1 | 3/1997 |
| WO | WO 98/39947 A1 | 9/1998 |
| WO | WO 00/33612 A2 | 6/2000 |
| WO | WO 00/65869 A2 | 11/2000 |
| WO | WO 01/05189 A2 | 1/2001 |
| WO | WO 01/47320 A1 | 6/2001 |

OTHER PUBLICATIONS

Philips Loudspeaker System Brochure, "Philips HiFi Ludsprekerboxen"; circa 1980; cover page.
Gontcharov et al.; NXT Technical Evaluation Report 0200; Philips 73mm Flat Midrange Driver; Type: AD 02170/SQ8; Jun. 29, 2004; pp. 1–7.
Colloms; Declaration of Martin Colloms Regarding 1980s Philips Loudspeaker Drive Unit; Jul. 13, 2004; pp. 1–4.

* cited by examiner

*Primary Examiner*—Curtis Kuntz
*Assistant Examiner*—P. Dabney
(74) *Attorney, Agent, or Firm*—Foley & Lardner LLP

(57) ABSTRACT

A loudspeaker comprising a panel-form acoustic member adapted for operation as a bending wave radiator and an electrodynamic moving coil transducer having a voice coil mounted to the acoustic member to excite bending wave vibration in the acoustic member. The junction between the voice coil and the acoustic member is of sufficient length in relation to the size of the acoustic member to represent a line drive such that the acoustic member has a mechanical impedance which has a rising trend with bending wave frequency.

46 Claims, 9 Drawing Sheets

LOUDSPEAKERS

This application claims the benefit of provisional application No. 60/250,106, filed Dec. 1, 2000.

TECHNICAL FIELD

The invention relates to bending wave panel loudspeakers, e.g. resonant bending wave panel speakers of the kind exemplified by WO97/09842, and to drive motors for such speakers.

BACKGROUND ART

In making electro-dynamic, that is moving coil, vibration transducers for bending wave panel speakers, current thinking on voice coil size and mass tends towards the use of small diameter and low mass voice coil systems, typically of the size of tweeter coils of conventional pistonic speakers. In certain applications, e.g. for driving bending wave panels or diaphragms as exemplified by WO98/39947, which are intended to be driven centrally, e.g. so that they can act both pistonically and in bending, such small diameter voice coils may cause power handling and excursion-related problems.

For such small diameter voice coils the drive point impedance (Zm) approximates to that of a panel driven at a single point. As the frequency is increased Zm oscillates with modal structure but is on average constant and approximates to the infinite panel value given by the following equation:

$$Zm=8\sqrt{B\mu}$$

As a result, for a given voice coil mass (Mc) there is a high frequency limit (f(b)) above which the rising impedance of this mass exceeds the constant drive point impedance. This frequency is given by the following equation:

$$f(b)=\frac{Zm}{2\pi Mc}$$

Consequently the voice coil mass on known bending wave panels has been kept low according to the above formula.

The obvious way is to increase Zm or reduce Mc in order to keep the turnover frequency high in the audio band. Voice coil diameter has only ever been increased slightly and then only to find that the cell cap, drum-mode resonance becomes dominant and causes premature roll-off.

Other issues that work against low mass voice coils for pistonically driven panels are sensitivity and bandwidth. In order to keep a realistic low frequency bandwidth in a realistic enclosed volume, the diaphragm mass needs to be high. So, to keep sensitivity up, the Bl force factor will need to be high. High Bl drivers usually rely on the number of turns to increase the Bl product and thus increase voice coil mass.

Another direction is to use an under-hung vibration exciter design relying on the magnet to increase the Bl product and thus keeping voice coil mass low. This has been tried using a 25 mm voice coil diameter and an increased stiffness over the drive point. But power handling and excursion are still restricted.

It is known from WO97/09842 to provide a flat panel loudspeaker which operates pistonically at low frequencies and which is resonant at high frequencies. It is also known from U.S. Pat. No. 4,542,383 to provide a loudspeaker having a moving coil transducer and a diaphragm, both being of similar diameter and the voice coil being arranged to drive the diaphragm around its periphery.

SUMMARY OF THE INVENTION

According to the invention, there is provided a loudspeaker comprising a panel-form acoustic member adapted for operation as a bending wave radiator and an electrodynamic moving coil transducer having a voice coil mounted to the acoustic member to excite bending wave vibration in the acoustic member, wherein the junction between the voice coil and the acoustic member is of sufficient length in relation to the size of the acoustic member to represent a line drive such that the acoustic member has a mechanical impedance which on average rises with bending wave frequency. The junction of the voice coil and the diaphragm may be circular and the junction may be substantially continuous.

A sufficient length voice coil junction in the present context is one in which the length, or its diameter in the case of a circular junction, is equal to at least the length of a bending wave in the portion of the acoustic member defined by the junction, or circumscribed by the voice coil, at the highest operating frequency of the loudspeaker.

The mechanical impedance of a panel is equal to the ratio of force applied at a single point to the resultant velocity at this point. Where the panel is driven by force acting over a line, the effective mechanical impedance is the ratio of total force applied over the line to the resultant velocity averaged over the length of the line. In the present description and claims the use of the term mechanical impedance is used to describe this ratio for both drive arrangements.

It will be understood that for a point driven plate or diaphragm it is only an infinite diaphragm that has a truly constant Zm. A finite diaphragm has a Zm that oscillates about the infinite diaphragm value. Similarly the mechanical impedance seen by a large area voice coil on the diaphragm will oscillate with modal structure but will on average rise with frequency.

The portion of the acoustic member circumscribed by the said voice coil may be of different stiffness as compared to a portion of the acoustic member outside the voice coil.

The transducer may be arranged both to move the acoustic member in whole body mode and to apply bending wave energy to the acoustic member. The size, shape and position of the junction between the voice coil and the acoustic member may be adjusted in relation to the modal distribution of the diaphragm or acoustic member in order to achieve a smooth transition from whole body motion at low frequencies to resonant bending wave behaviour at higher frequencies. By way of example, in the case of a circular diaphragm, normally driven, the second resonance may give rise to an irregularity in the output. With a circular driveline the effective perimeter of the driveline may be chosen in location and size to lie on or near to the nodal circle of the second resonance. In this context the first resonance is the whole body or piston equivalent resonance. By coupling at or near the nodal circle for the second resonance its effect is reduced and the mode is driven weakly or not at all. Thus the designer may adjust the drive parameters to increase the sound quality from the low piston frequencies to the modally denser region at mid frequencies.

Mass loading may be applied to the acoustic member within the diameter of the voice coil. The acoustic member may be non-circular in shape. The transducer voice coil may be concentric with the geometric centre of the acoustic member.

A second transducer may be coupled to the acoustic member within the portion thereof circumscribed by the voice coil and adapted to cause high frequency bending wave activity of the circumscribed portion. The second transducer may be offset from the axis of the voice coil.

A coupling may be provided to attach the voice coil to the acoustic member, the coupling having a footprint of non-circular shape.

The portion of the acoustic member circumscribed by the voice coil may be stiffer than a portion of the acoustic member outside the voice coil. The bending stiffness of the acoustic member may be anisotropic. The acoustic member may be curved or dished or otherwise formed to increase its bending stiffness.

The loudspeaker may comprise a chassis having a portion surrounding the acoustic member, and a further portion supporting the electrodynamic transducer, and may further comprise a resilient suspension connected between the acoustic member and the surrounding chassis portion for resiliently suspending the acoustic member on the chassis. The resilient suspension may be connected between the chassis and the margin of the acoustic member. The resilient suspension may be adapted to mass load the acoustic member. The resilient suspension may be adapted to damp the acoustic member. The resilient suspension may be at least partly formed by a skin of the acoustic radiator.

The acoustic member may have a front side from which acoustic energy is radiated, and may comprise an acoustic mask positioned over the portion of the acoustic member circumscribed by the voice coil, the mask defining an acoustic aperture.

The electrodynamic moving coil transducer may be offset from the geometric centre of the acoustic member, and a counter balance mass may be provided on the acoustic member.

The action of the large area voice coil on the diaphragm can produce a distribution of excited modes that results in significant beaming of the radiation on-axis, at least over some of the frequency range. In some applications, such as zoning of the output sound, this may be advantageous, but in many applications off-axis power is desirable. One approach to improving off-axis power is to excite the panel in bending wave vibrations at frequencies near to or greater than the coincidence frequency.

The coincidence frequency is the frequency at which the bending wave velocity in the plate equals the velocity of sound in air. Above this frequency the velocity in the plate exceeds the velocity in air, and this supersonic vibration can give rise to strongly directional radiation off-axis. In fact at the coincidence frequency, radiation is beamed directly off-axis with the angle of beaming moving closer to the on-axis direction with increasing frequency. The coincidence frequency of a plate is determined by its bending stiffness (B) and mass density (mu). These parameters may be varied such that the narrowing of the radiation pattern resulting from the large area voice coil is compensated for, at least to some degree, by the additional energy beamed off-axis by the bending wave vibration above the coincidence frequency.

The loudspeaker of the present invention may be adapted to operate as a full range device.

BRIEF DESCRIPTION OF THE DRAWING

Examples that embody the best mode for carrying out the invention are described in detail below and are diagrammatically illustrated in the accompanying drawing, in which.

DETAILED DESCRIPTION

Figure 1:
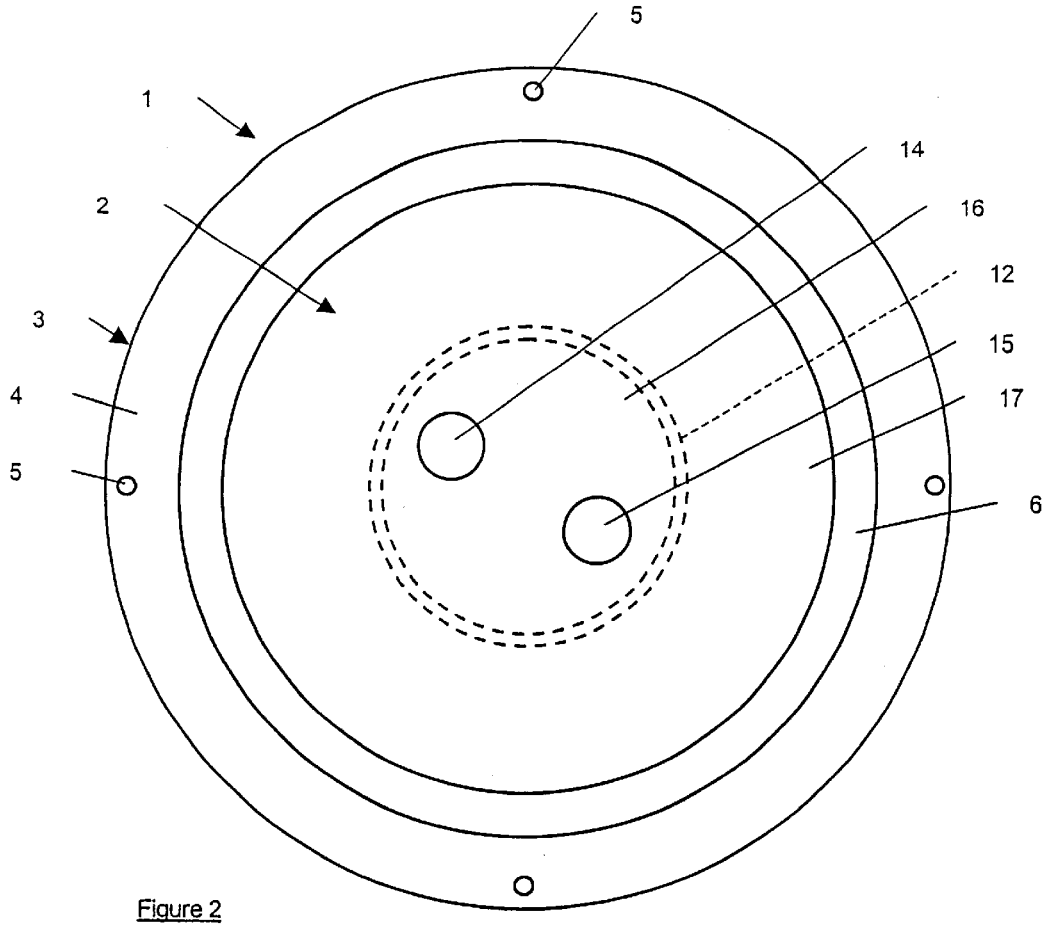
FIG. 1 is a front elevational view of a loudspeaker driver motor.
Figure 2:
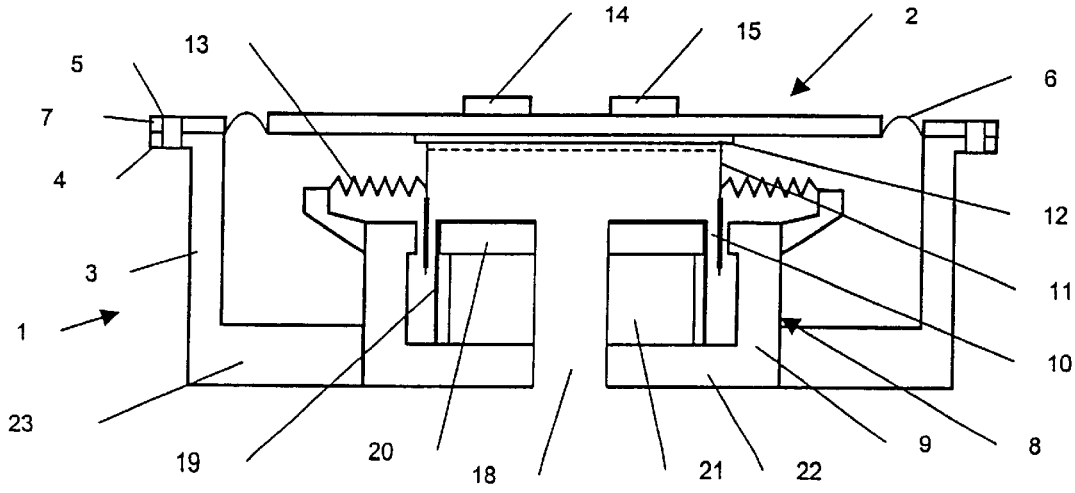
FIG. 2 is a schematic cross-sectional side view of the drive motor of FIG. 1.
Figure 25:
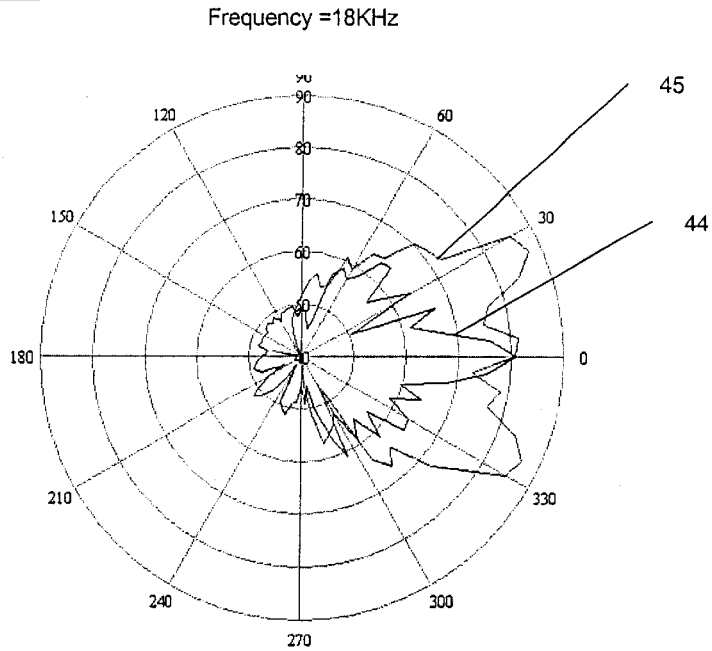
FIG. 25 is a polar diagram comparing the response of a conventional pistonic speaker with that of the present invention.

In FIGS. 1 and 2 there is shown a loudspeaker driver motor (1) adapted to be mounted to a baffle, e.g. in an enclosure, see FIGS. 3 and 4 below, comprising a circular flat diaphragm of stiff lightweight material, comprising, for example, a core sandwiched between skins of high tensile sheet material, which forms an acoustic member or radiator adapted to operate both pistonically and by flexure as a bending wave resonant device at higher frequencies. In this way the driver motor of the present invention is able to operate as a full range device covering substantially the whole of the audio spectrum with wide acoustic dispersion, unlike a conventional pistonic driver, whose frequency band or at least its dispersion angle is limited at high frequencies by the diameter of the diaphragm, see FIG. 25 below, and a bending wave driver, which tends to roll-off at frequencies below about 200 Hz, unless of very large diaphragm size.

In generally conventional manner the diaphragm (2) is supported in a chassis or basket (3), e.g. of metal formed at its front with an annular flange (4) having a plurality of spaced fixing holes (5) whereby the chassis can be fixed in a suitable aperture in a loudspeaker enclosure, see FIGS. 3 and 4 below. A corrugated suspension (6) e.g. of rubber-like material is fixed to the diaphragm round its periphery by means of an adhesive and the suspension is clamped to the annular flange (4) with the aid of a clamping ring (7), whereby the diaphragm can move pistonically relative to the chassis.

The chassis supports an electrodynamic moving coil transducer (8) for moving the diaphragm pistonically and for applying bending wave energy to the diaphragm to cause it to resonate, e.g. in the manner generally described in WO97/09842 and its US counterpart (U.S. application Ser. No. 08/707,012, filed Sep. 3, 1996, which is incorporated herein by reference). The transducer comprises a magnet assembly (9) fixed to the chassis and defining an annular gap (10) concentric with the diaphragm and a voice coil and former assembly (11) collectively voice coil mounted for axial movement in the annular gap and which is fixed to the diaphragm concentrically therewith by a coupler ring (12). In generally conventional fashion, a corrugated suspension spider (13) is fixed between the voice coil assembly and the chassis to ensure the proper axial movement of the voice coil in the annular gap.

The voice coil diameter is large in relation to the bending wave length and the effect of this is that of a line drive to the diaphragm instead of a point drive as is normal for bending wave radiators using electrodynamic exciters having small diameter voice coils. This line drive provides a significant increase in the mechanical drive impedance presented to the voice coil, and this higher mechanical impedance enables the system to tolerate relatively high mass voice coils without premature roll off of high frequencies. Also, because of the large diameter of the voice coil, it is possible to manipulate the diaphragm panel stiffness to allow the portion of the diaphragm circumscribed by the voice coil to have multiple modes instead of a single dominant drum mode as can happen with a small diameter voice coil. An inner portion (16) of the diaphragm is circumscribed by the voice coil as seen in FIG. 1, while an outer portion (17) of the diaphragm extends radially outside the voice coil.

As shown in FIGS. 1 and 2, small masses (14, 15) are attached to the diaphragm inside the voice coil diameter to tune and/or smooth the frequency response of the acoustic radiator. Such masses are not always essential but may usually be desirable. These masses are shown as discrete masses but need not necessarily be discrete. They may have masses in the range 0.5 g to 100 g, and typically in the range 2 g to 20 g. One or more such mass may be provided.

The loudspeaker driver embodiment of FIGS. 1 and 2 has been optimised for use in a hi-fi loudspeaker, when coupled to an amplifier which has a flat voltage transfer function throughout the audio band. With this as part of the design criteria for this embodiment, the following design parameters are applicable.

The transducer has a large 75 mm diameter voice coil mounted in a low inductance motor system having a vent (18), having a copper eddy current shield (19) over the pole piece or front plate (20). FIG. 2 shows a cross section of a magnetic ring (21) of neodymium, centrally mounted in a steel magnetic circuit comprising a magnet cup (22) and the front plate (20) resulting in an average B field of 0.8 T. The voice coil (11) over-hangs the magnet front plate (20) to give an over-hung configuration. The voice coil consists of a winding height of 14.5 mm of aluminium turns on a 0.1 mm thick aluminium former. The voice coil parameters are given below:

Mandrel or former diameter=75 mm

Number of coil layers=2

Wire diameter=0.3 mm

Number of turns=71

The coupler ring (12) is required to provide a secure interface between the voice coil and the diaphragm. This nests inside of the voice coil. A 2.5 mm overlap is provided to allow for a good bond area between the coupler and the voice coil former. The coupler ring extends the effective length of the voice coil by 1.7 mm, giving a ring width of 3.5 mm to couple to the diaphragm. This is shown in FIG. 2. The material of the coupler ring is commercial grade thermoplastic or thermoset resin, e.g. ABS, which gives a mass of 3.4 g. For the bonding between the voice coil and coupler a thermally resistant cyanoacrylate is used (e.g. LOCTITE® 4212). This is also used to bond the coupler to the diaphragm.

The dynamic parameters of the motor system with the coupler ring are shown below:

Mms=11 g (Moving mass of the voice coil assembly)

Rms=1.95 Ns/m (Mechanical resistance of suspension)

Bl=8.1 Tm (Motor conversion factor)

Re=6.5 ohm (DC resistance of voice coil)

Fs=40 Hz (Mass spring resonance of system)

Le=0.2 mH (Inductance factor of voice coil @1 kHz)

The diaphragm material used is as follows:

Material: ROTREX LITE™ 51LS 3.5 mm (3.5 mm thick 51LS grade uncompressed ROHACELLS® core of rigid closed cell polymethacrylimide thermoplastic foam with a glass veil/thermoplastic skin).

Diameter: 120 mm.

The diaphragm parameters are given below in Table 1:

TABLE 1

| | | | |
|---|---|---|---|
| Mass Area Density | M | 0.35 | Kg/m2 |
| Poisson ratio | N | 0.11 | |
| Bending rigidity | D1 | 2.4 | Nm |
| Bending Rigidity | D2 | 1.8 | Nm |
| Damping D | η | 0.02 | |
| In plane shear ratio | Shr | 0.36 | |
| Thickness | T | 3.5 mm | M |
| Shear modulus | Gz | 19M | Pa |
| Damping Gz | η | 1 | |
| Coincidence Frequency | Fc | 7.7 | KHz |

From the parameters given in Table 1, the wavelength of the panel may be calculated at the highest frequency of operation, i.e. 20 kHz. This calculation gives a wavelength of 28 mm, based on an average bending stiffness of 2.1 Nm. The voice coil diameter is therefore 2.7 times the wavelength at the highest frequency of operation. In the prior art of bending wave speakers, the first aperture resonance corresponds to a half wavelength within the voice coil.

The coincidence lobe of this panel gives strong acoustic output off axis close to or above coincidence frequency as given in Table 1 above. As indicated in the directivity plot of FIG. 25, in which the thin line or trace (45) is a plot of a speaker according to the invention with a 300 mm diameter diaphragm, and the thick trace (44) is of a conventional pistonic diaphragm of 250 mm diameter.

The chassis consists of an aluminium back plate (23) to support the transducer (8) and which is connected to the front flange (4). Allen bolts (not shown) are used to secure the clamping ring (7) to the flange (4).

The pair of masses (14, 15) fixed to the diaphragm are to smooth the first drum mode within the inner portion of the diaphragm, at approximately 2 kHz.

The motor drive unit parameters are given below:

dD=14 cm (Diameter of radiating area (centre to centre of the surround))

Mms=27 g (Moving mass of the voice coil and diaphragm assembly)

Rms=2.4 Ns/m (Mechanical resistance of suspension)

Bl=8.1 Tm (Motor conversion factor)

Re=6.5 ohm (DC resistance of voice coil)

Fs=33 Hz (Mass spring resonance of system)

Le=0.2 mH (Inductance factor of voice coil @1 kHz)

Figure 3:
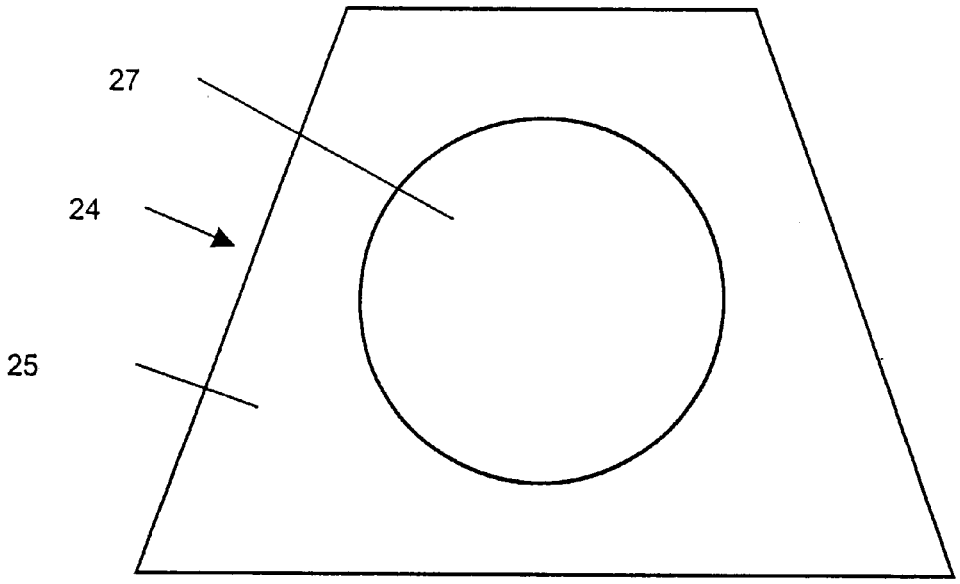
FIG. 3 is a front elevational view of a loudspeaker enclosure.
Figure 4:
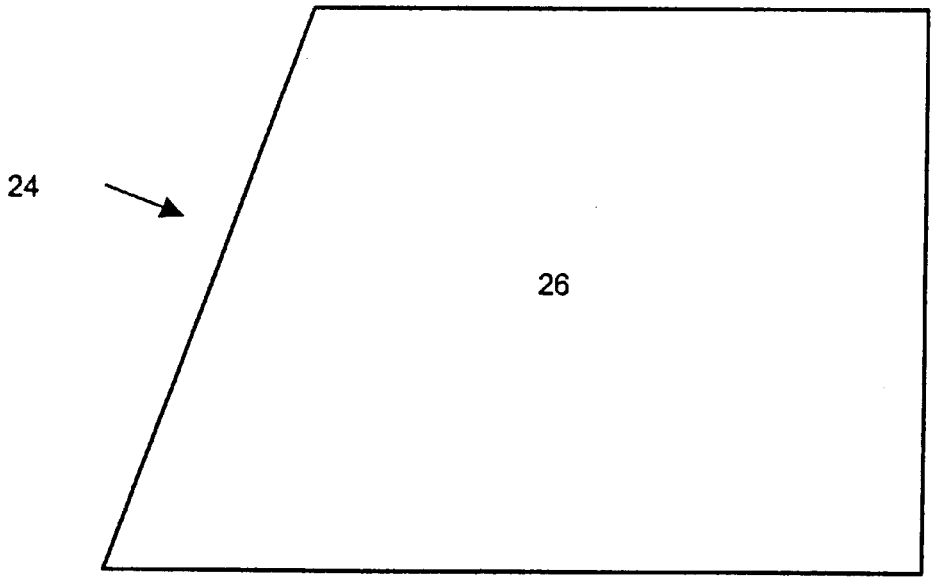
FIG. 4 is a side elevational view of the loudspeaker enclosure of FIG. 3.

FIGS. 3 and 4 show a loudspeaker enclosure (24) for the drive unit of FIGS. 1 and 2 and having a sloping front (25) and sides (26). An aperture (27) is provided in the front (25) to receive the drive unit or motor (1). The enclosure has been designed to give a volume of 17 litres giving a maximally flat alignment. The enclosure form is chosen to smear internal enclosure standing waves, although this is not essential to the design and operation of the speaker. The enclosure is constructed from 18 mm medium density fibreboard (MDF). The joints are glued (using PVA wood glue) and screwed to give an air tight seal.

Figure 5:
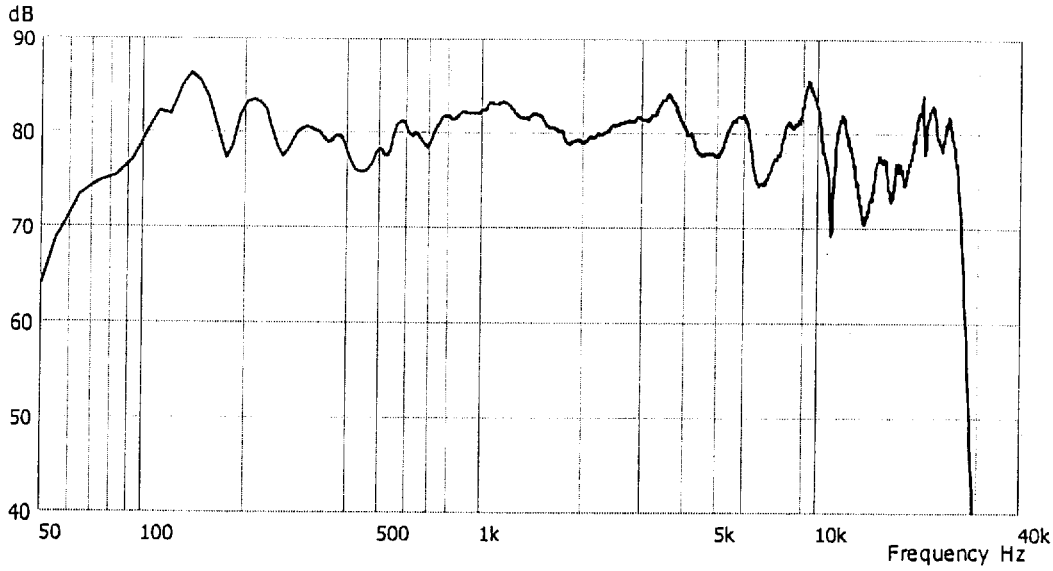
FIG. 5 is a graph of frequency response.
Figure 6:
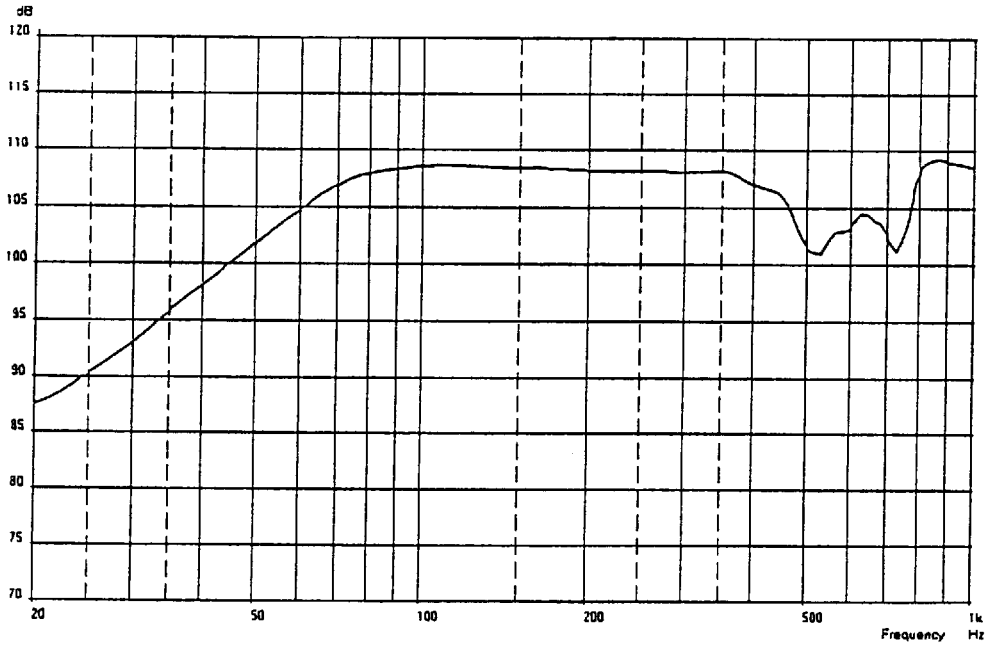
FIG. 6 is a graph of near field bass frequency response.

FIGS. 5 and 6 show measurements of the above embodiment of the speaker taken in an anechoic chamber with the microphone positioned at 1 m (on axis with the diaphragm) at 2.83 v. Inaccuracies occur below approximately 200 Hz for the measurement shown in FIG. 5, so a near field measurement showing the low frequency performance is given in FIG. 6.

Figure 7:
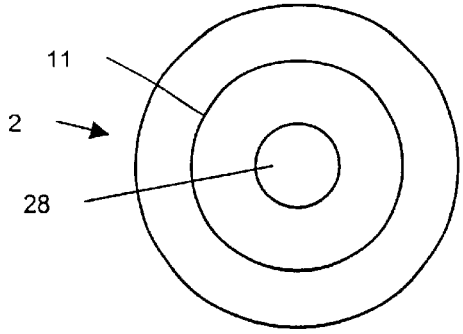
FIGS. 7 to 9 are front elevational views of three embodiments of diaphragm, each having a supplementary vibration exciter.
Figure 8:
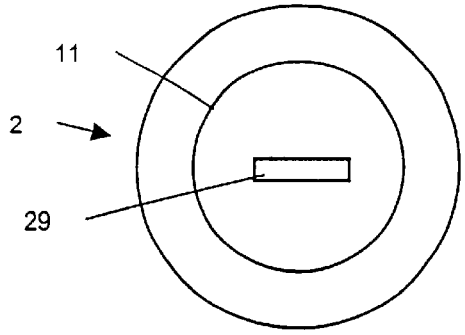
Figure 9:
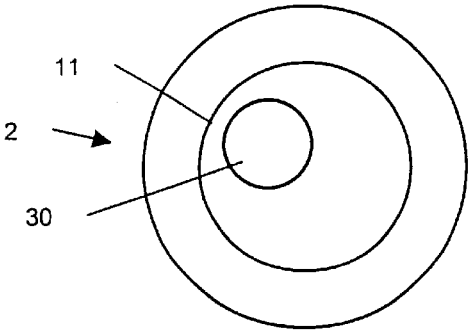

While the embodiment of FIGS. 1 and 2 employs a single large diameter voice coil driver, a supplementary exciting device could be used to improve the high frequency level and/or extension and directivity performance of the loudspeaker. The supplementary exciter could be placed anywhere on the diaphragm to provide a smaller radiation area. Devices such as piezos of large area, small area or strip-like form or smaller moving coil devices could be used. This is illustrated in FIGS. 7 to 9. In FIG. 7 it will be seen that a circular piezo disc vibration exciter (28) has been mounted on the diaphragm (2) at its centre and inside the diameter of the voice coil (11). In the embodiment of FIG. 8, a piezo strip vibration exciter (29) has been mounted on the diaphragm (2) concentrically therewith and inside the diameter of the voice coil (11). In FIG. 9, a circular disc vibration exciter (30) has been mounted on the diaphragm (2) inside the voice coil diameter (11) but off centre.

It can be shown that the voice coil moving mass has little effect on the high frequency extension of the speaker. Therefore the present invention is not restricted to lightweight voice coils. This implies scope for employing moving magnet motor systems and/or relatively high mass coupler rings between the voice coil assembly and the diaphragm which currently might be excluded from small drive area or point drive designs of bending wave speaker. This could allow complex coupler designs to transform the voice coil ring to other beneficial shapes so as to improve performance.

Figure 10:
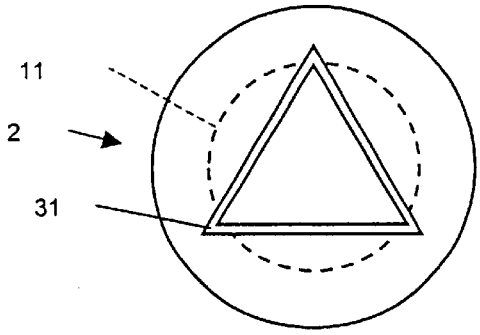
FIGS. 10 to 13 are front elevational views of four further embodiments of diaphragm.
Figure 11:
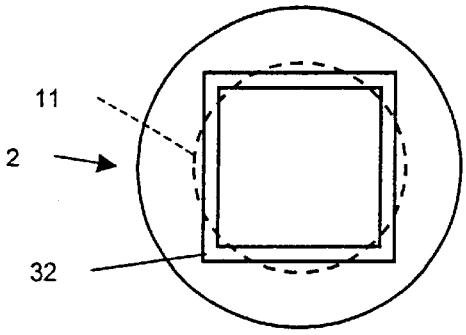
Figure 12:
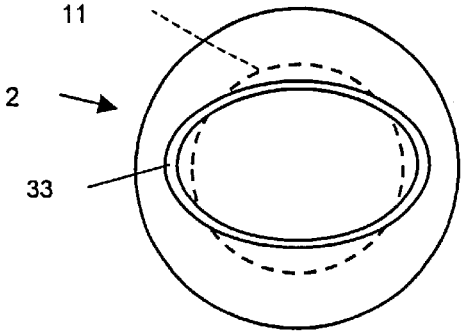
Figure 13:
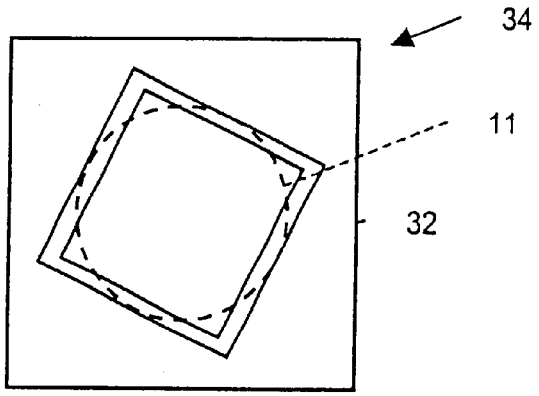

Examples of triangular, square and oval shapes of coupler ring are shown in FIGS. 10 to 12, respectively, under references (31) to (33) respectively. These shapes have implications on the distribution of modes excited and therefore directivity implications. If, for example, as shown in FIG. 13, a rectangular diaphragm (34) has been chosen this, together with a rectangular coupler ring (32) rotated by an angle relative to the diaphragm sides, could provide a more irregular modal pattern in the diaphragm. This could also further improve frequency response on and off axis.

In the embodiment of FIGS. 1 and 2, the voice coil diameter is 75 mm. This can be increased or decreased depending on the design specification. If the design specification requires narrow directivity for zoning applications, a larger voice coil coupled to a low wave speed panel, i.e. having a very high Fc, could be used. Conversely, if wide directivity is required a smaller voice coil can be used, within the criteria of line drive. However this may need electrical high frequency boost to maintain constant pressure throughout the audio band.

As indicated in FIG. 13 above, the invention is not limited to the circular panel shape shown in the embodiment of FIGS. 1 and 2. Other shapes can be beneficial in directivity and/or frequency response, because of the different mode shapes that result from the geometry of the panel. It is expected that the more complex the mode shapes in the panel, the less directivity there will be in the acoustic output. Examples include square, rectangular and hexagonal panels.

Figure 14:
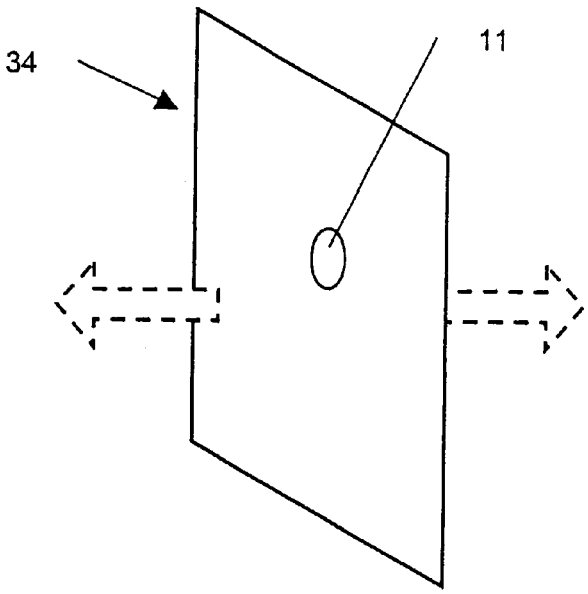
FIG. 14 is a perspective diagram of a further embodiment of diaphragm.
Figure 15:
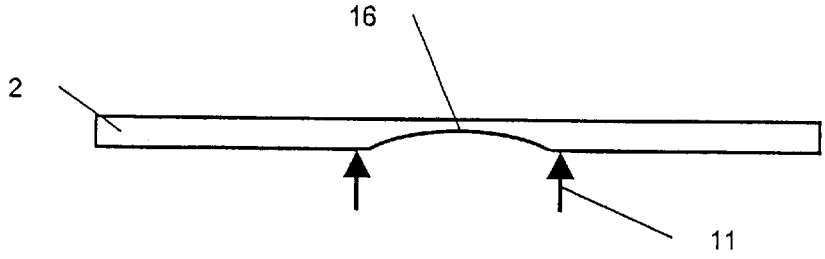
FIGS. 15 to 18 are cross-sectional views of four embodiments of diaphragm.

Also, as shown in FIG. 14, the invention is not restricted to pure piston behaviour of the diaphragm at low frequency, and may be quasi-tympanic at low frequencies. The diaphragm (34) could be a large radiating panel. This would provide a means of self-baffling giving a dipole bass response as indicated by opposed arrows. The panel edges could be free or clamped.

Figure 16:
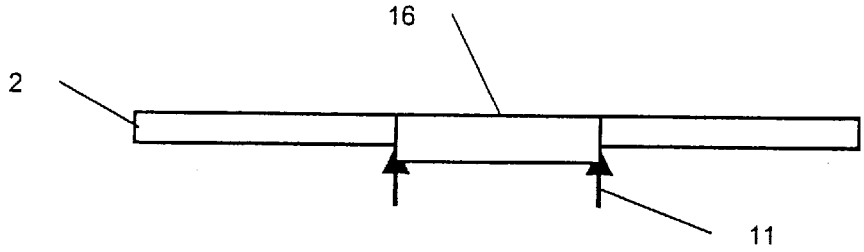
Figure 17:
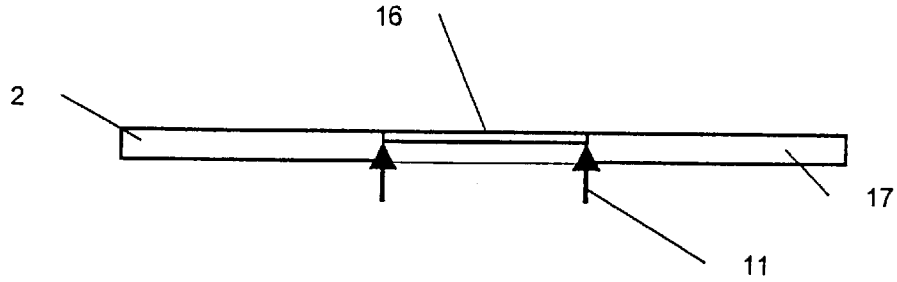
Figure 18:
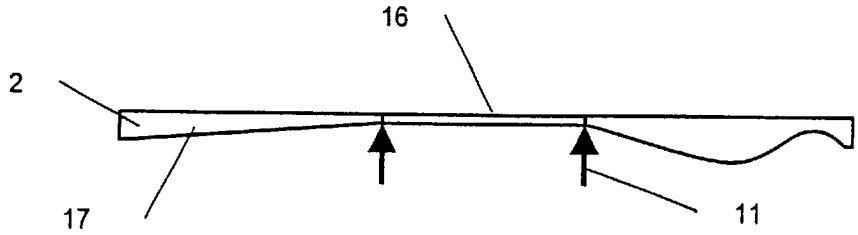

The invention is not restricted to a flat diaphragm or to a single material type. Profiling and shaping of the diaphragm can be used to alter the modal behaviour. For example, the part of the diaphragm circumscribed by the voice coil could be constructed from a different material or the same material but thicker or thinner. Exemplary embodiments are shown in FIGS. 15 to 18. Stiffness can be applied to the diaphragm by profiling. Stiffness variation can also be realised by using material isotropy. Thus in FIG. 15, the inner portion (16) of the diaphragm (2) is thinned by dishing its undersurface. In FIG. 16, the inner portion (16) of the diaphragm is thickened. In FIG. 17, the inner portion (16) of the diaphragm (2) is uniformly thinner than the outer portion (17) of the diaphragm. In FIG. 18 the outer portion (17) of the diaphragm (2) progressively tapers in thickness towards the inner portion, as seen in the left-hand side of the figure, and is formed with a curved profile of varying thickness as seen on the right-hand side of the figure.

Figure 19:
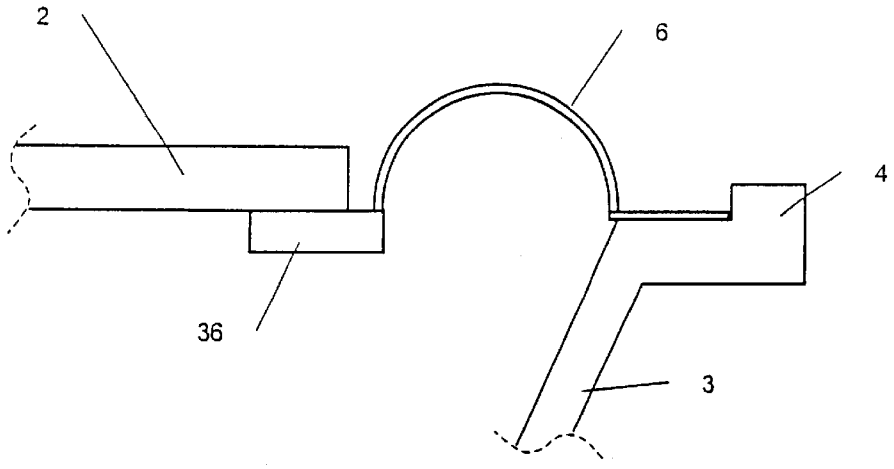
FIGS. 19 to 21 are cross-sectional views of three embodiments of diaphragm surrounds or suspensions.
Figure 20:
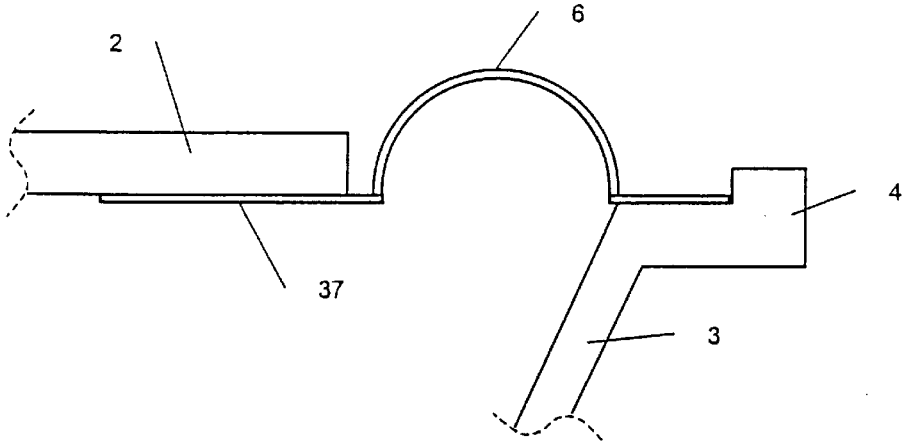
Figure 21:
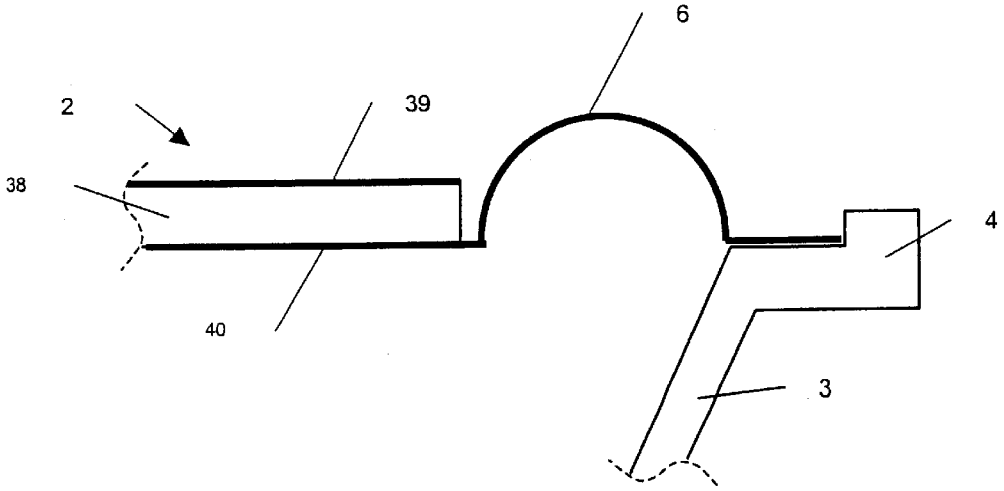

It can be shown that the diaphragm surround affects acoustic performance. Both the piston and modal region can be varied by changing the material properties of the surround. In particular, if mass is applied to the perimeter of the diaphragm as shown at (36) in FIG. 19, high frequency performance can be improved. Edge damping of the diaphragm can be applied to control its modal behaviour. This can be in the form of surface treatment, or edge damping can be by means of the surround footprint, as indicated at (37) in FIG. 20. The panel skins, or one of them, could be used to form the surround as indicated in FIG. 21. In this embodiment the diaphragm comprises a core (38) and skins (39, 40) covering the core. The lower skin (40) is extended to form the surround or suspension (6). This may give cost advantages. Advantages could also include low-loss termination of the diaphragm.

Radiation at frequencies close to and greater than the coincidence frequency (Fc) is used in the preferred embodiment to widen directivity at high frequency. However coincidence can be set at either end of the spectrum. Increasing the panel stiffness/lowering the coincidence frequency should still give wide directivity and improved modal region sensitivity.

Using isotropic diaphragms, e.g. at approximately two times Fc, will give side lobes in the same position in both planes. When using non-isotropic panels, coincidence can be set independently in alternate planes thus giving a smoother total power response.

Mechanical components, e.g. mass or voice coil coupling to the panel, can provide a means of mechanical filtering. By placing an interface between the voice coil coupler and the panel the frequency response can be modified. Passive component electrical shelving or amplifier transfer function shelving/high frequency boost could also be employed to modify the acoustic output of the device.

Figure 22:
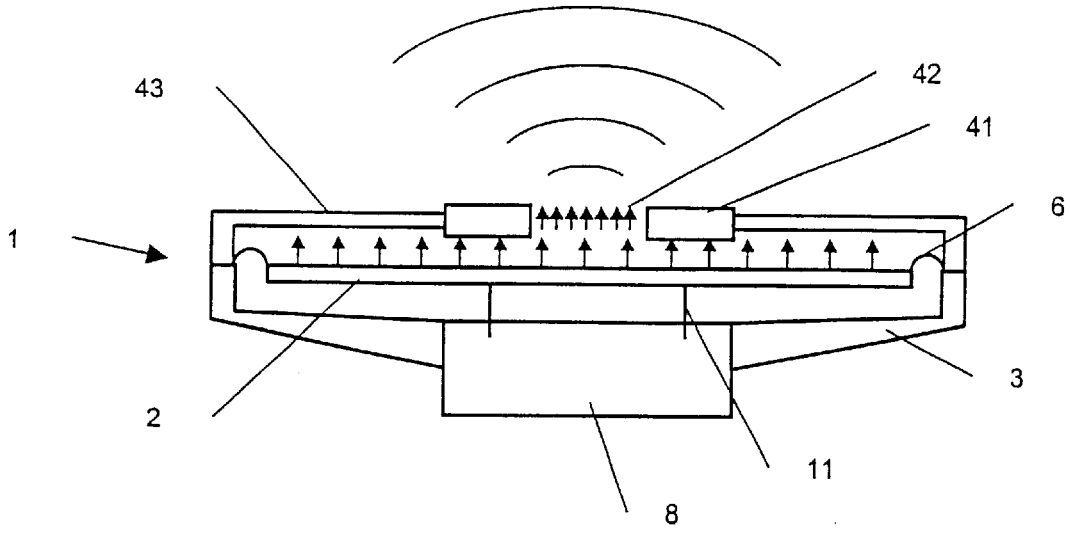
FIG. 22 is a schematic cross-sectional view of an embodiment of speaker driver motor.

In the embodiment of FIGS. 1 and 2, coherent sound radiates from the annular area where the voice coil is fixed to the diaphragm. This can cause beaming at high frequencies due to the large radiating area relative to the wavelength in air. As shown in FIG. 22, to widen the directivity at high frequencies, a mask (41) having a small aperture (42) can be placed over the inner portion (16) of the diaphragm (2) on a support (43) mounted on the chassis (3) to transform this into a smaller radiating area. This effect has been seen when measurements have been taken from the rear of the device. In the embodiment of FIGS. 1 and 2 the vent (18) in the motor system forms the mask aperture, as concerns rear radiation.

Figure 23:
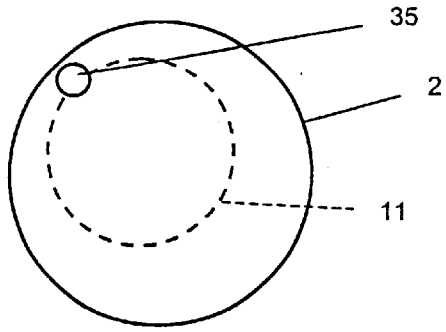
FIG. 23 is a front elevational view of another embodiment of diaphragm.

If desired, as shown in FIG. 23, the voice coil (11) may be positioned off-centre on the diaphragm (2) to improve the distribution of resonant modes excited in the diaphragm, with a counterbalancing mass (35) positioned on the diaphragm to prevent rocking.

Figure 24:
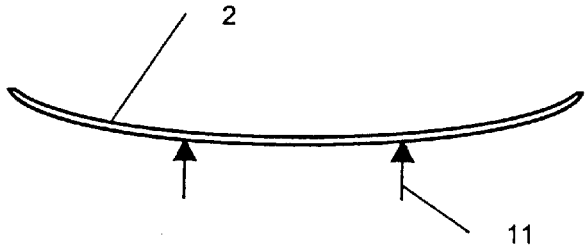
FIG. 24 is a cross-sectional view of an embodiment of diaphragm.

As shown in FIG. 24, the diaphragm (2) need not be flat and can be dished or otherwise formed to increase its stiffness. This may be in the form of a curvature which varies across the diaphragm so that the stiffness is greater towards the edges of the diaphragm, as shown. This curvature or profiling of the diaphragm may assist in scaling the diaphragm while keeping the Fc constant, and may also be beneficial in smoothing the piston to modal transition, especially for larger diaphragms.

Figure 26:
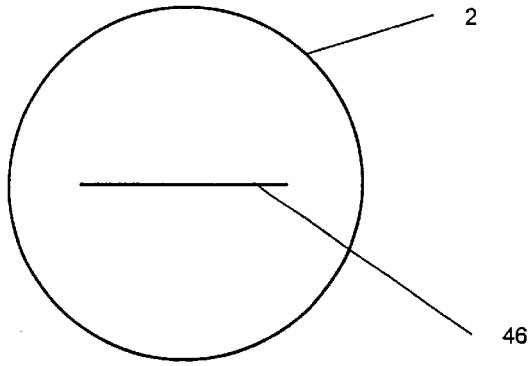
FIGS. 26 and 27 are front elevational views of two further embodiments of voice coil/diaphragm line drive junctions.

In FIG. 26 there is shown a circular diaphragm (2) which is driven by the voice coil of a transducer (not shown) having a rectilinear coupler (46), equivalent to the coupler ring (12) of the embodiment of FIGS. 1 and 2, connected between the voice coil and the diaphragm to provide a straight line drive junction. The coupler (46) is arranged and disposed on a diameter of the diaphragm and with its ends equally spaced from the opposite edges of the diaphragm.

Figure 27:
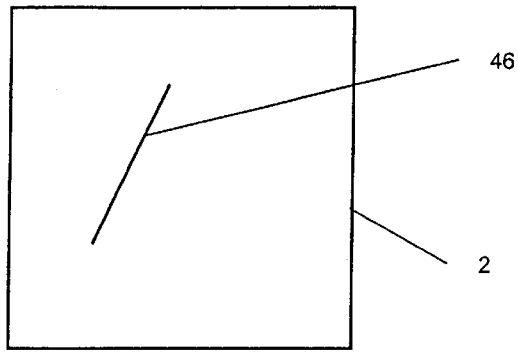

In FIG. 27 there is shown a rectangular diaphragm (2) driven by a voice coil of a transducer (not shown) with a rectilinear coupler (46) connected between the voice coil and the diaphragm to provide a straight line drive junction. The coupler (46) is positioned off centre of the diaphragm and angled with respect to the sides of the diaphragm.

The present invention thus provides an effective way of increasing the frequency bandwidth of a bending wave speaker.

What is claimed is:

1. A loudspeaker comprising a panel-form acoustic member adapted for operation as a bending wave radiator and an electrodynamic moving coil transducer having a voice coil mounted to the acoustic member to excite bending wave vibration in the acoustic member, wherein the junction between the voice coil and the acoustic member is of sufficient length in relation to the size of the acoustic member to represent a line drive such that the acoustic member has a mechanical impedance which has a rising trend with bending wave frequency.

2. A loudspeaker according to claim 1, wherein the junction between the voice coil and the acoustic member is circular.

3. A loudspeaker according to claim 2, wherein the junction between the voice coil and the acoustic member is substantially continuous.

4. A loudspeaker according to claim 3, wherein the portion of the acoustic member circumscribed by the voice coil is of different stiffness as compared to a portion of the acoustic member outside the voice coil.

5. A loudspeaker according to claim 3, wherein the acoustic member is also adapted to be moved in whole body mode by the transducer.

6. A loudspeaker according to claim 5, comprising a mass loading the acoustic member within the diameter of the voice coil.

7. A loudspeaker according to claim 3, wherein the acoustic member is non-circular in shape.

8. A loudspeaker according to claim 7, wherein the transducer voice coil is concentric with the geometric centre of the acoustic member.

9. A loudspeaker according to claim 3, comprising a second transducer coupled to the acoustic member within the portion thereof circumscribed by said voice coil and adapted to cause high frequency bending wave activity of said circumscribed portion.

10. A loudspeaker according to claim 9, wherein the second transducer is offset from the axis of said voice coil.

11. A loudspeaker according to claim 3, comprising a coupling attaching said voice coil to the acoustic member, the coupling having a footprint of non-circular shape.

12. A loudspeaker according to claim 4, wherein the portion of the acoustic member circumscribed by the voice coil is stiffer than a portion of the acoustic member outside the voice coil.

13. A loudspeaker according to claim 3, wherein the bending stiffness of the acoustic member is anisotropic.

14. A loudspeaker according to claim 3, comprising a chassis having a surrounding portion surrounding the acoustic member and a further portion supporting the electrodynamic transducer, and a resilient suspension connected between the acoustic member and the surrounding portion of the chassis for resiliently suspending the acoustic member on the chassis.

15. A loudspeaker according to claim 14, wherein the resilient suspension is connected between the chassis and the margin of the acoustic member.

16. A loudspeaker according to claim 15, wherein the resilient suspension is adapted to mass load the acoustic member.

17. A loudspeaker according to claim 15, wherein the resilient suspension is adapted to damp the acoustic member.

18. A loudspeaker according to claim 17, wherein the resilient suspension is at least partly formed by a skin of the acoustic radiator.

19. A loudspeaker according to claim 3, wherein the acoustic member has a front side from which acoustic energy is radiated, and comprising an acoustic mask positioned over the portion of the acoustic member circumscribed by the voice coil, the mask defining an acoustic aperture.

20. A loudspeaker according claim 3, wherein the electrodynamic moving coil transducer is offset from the geometric centre of the acoustic member, and comprising a counter balance mass on the acoustic member.

21. A loudspeaker according to claim 3, adapted to operate as a full range device.

22. A loudspeaker according to claim 3, wherein the acoustic member is dished to increase its stiffness.

23. A loudspeaker according to claim 3, wherein the loudspeaker is adapted to operate with the acoustic member excited in bending wave vibration at frequencies near to or greater than the coincidence frequency.

24. A loudspeaker according to claim 5, wherein the size, shape and/or position of the junction between the voice coil and the acoustic member is arranged in relation to the modal distribution of the acoustic member to achieve a smooth transition from whole body motion at low frequencies to resonant bending wave behaviour at higher frequencies.

25. A loudspeaker according to claim 1, wherein the junction between the voice coil and the acoustic member is substantially continuous.

26. A loudspeaker according to claim 1, wherein the portion of the acoustic member circumscribed by the voice coil is of different stiffness as compared to a portion of the acoustic member outside the voice coil.

27. A loudspeaker according to claim 1, wherein the acoustic member is also adapted to be moved in whole body mode by the transducer.

28. A loudspeaker according to claim 1, comprising a mass loading the acoustic member within the diameter of the voice coil.

29. A loudspeaker according to claim 1, wherein the acoustic member is non-circular in shape.

30. A loudspeaker according to claim 29, wherein the transducer voice coil is concentric with the geometric centre of the acoustic member.

31. A loudspeaker according to claim 1, comprising a second transducer coupled to the acoustic member within the portion thereof circumscribed by said voice coil and adapted to cause high frequency bending wave activity of said circumscribed portion.

32. A loudspeaker according to claim 31, wherein the second transducer is offset from the axis of said voice coil.

33. A loudspeaker according to claim 1, comprising a coupling attaching said voice coil to the acoustic member, the coupling having a footprint of non-circular shape.

34. A loudspeaker according to claim 26, wherein the portion of the acoustic member circumscribed by the voice coil is stiffer than a portion of the acoustic member outside the voice coil.

35. A loudspeaker according to claim 1, wherein the bending stiffness of the acoustic member is anisotropic.

36. A loudspeaker according to claim 1, comprising a chassis having a surrounding portion surrounding the acoustic member and a further portion supporting the electrodynamic transducer, and a resilient suspension connected between the acoustic member and the surrounding portion of the chassis for resiliently suspending the acoustic member on the chassis.

37. A loudspeaker according to claim 36, wherein the resilient suspension is connected between the chassis and the margin of the acoustic member.

38. A loudspeaker according to claim 37, wherein the resilient suspension is adapted to mass load the acoustic member.

39. A loudspeaker according to claim 37, wherein the resilient suspension is adapted to damp the acoustic member.

40. A loudspeaker according to claim 39, wherein the resilient suspension is at least partly formed by a skin of the acoustic radiator.

41. A loudspeaker according to claim 1, wherein the acoustic member has a front side from which acoustic energy is radiated, and comprising an acoustic mask positioned over the portion of the acoustic member circumscribed by the voice coil, the mask defining an acoustic aperture.

42. A loudspeaker according claim 1, wherein the electrodynamic moving coil transducer is offset from the geometric centre of the acoustic member, and comprising a counter balance mass on the acoustic member.

43. A loudspeaker according to claim 1, adapted to operate as a full range device.

44. A loudspeaker according to claim 1, wherein the acoustic member is dished to increase its stiffness.

45. A loudspeaker according to claim 1, wherein the loudspeaker is adapted to operate with the acoustic member excited in bending wave vibration at frequencies near to or greater than the coincidence frequency.

46. A loudspeaker according to claim 27, wherein the size, shape and/or position of the junction between the voice coil and the acoustic member is arranged in relation to the modal distribution of the acoustic member to achieve a smooth transition from whole body motion at low frequencies to resonant bending wave behaviour at higher frequencies.

* * * * *